US006315174B1

(12) United States Patent
Bowker

(10) Patent No.: US 6,315,174 B1
(45) Date of Patent: Nov. 13, 2001

(54) PORTABLE DISPENSING APPARATUS

(76) Inventor: David Bourchier Bowker, 60 Fairway, Durban North, 4051 (ZA)

( * ) Notice: Subject to any disclaimer, the term of this patent is extended or adjusted under 35 U.S.C. 154(b) by 0 days.

(21) Appl. No.: 09/443,269

(22) Filed: Nov. 18, 1999

(30) Foreign Application Priority Data

Nov. 18, 1998 (ZA) ..... 98/10546

(51) Int. Cl.[7] ..... B67D 5/00

(52) U.S. Cl. ..... 222/510; 222/470; 222/518; 222/540

(58) Field of Search ..... 222/470, 471, 222/510, 518, 540

(56) References Cited

U.S. PATENT DOCUMENTS

| | | | | |
|---|---|---|---|---|
| 568,150 | * | 9/1896 | Williams | 222/510 |
| 1,222,245 | * | 4/1917 | Schmoller | 222/470 |
| 1,439,259 | * | 12/1922 | Pasnik | 222/510 |
| 1,611,681 | * | 12/1926 | Schling | 222/510 |
| 1,749,853 | * | 3/1930 | Smith | 222/510 |
| 1,965,919 | * | 7/1934 | Bieger et al. | 222/510 |
| 2,123,606 | * | 7/1938 | Latocha | 222/510 |
| 2,600,131 | * | 6/1952 | Schwarm et al. | 222/510 |
| 2,656,071 | * | 10/1953 | Smith | 222/470 |
| 2,733,839 | * | 2/1956 | Blum | 222/471 |
| 4,286,737 | * | 9/1981 | Gallant | 222/470 |

* cited by examiner

*Primary Examiner*—J. Casimer Jacyna
(74) *Attorney, Agent, or Firm*—Senniger, Powers, Leavitt & Roedel

(57) ABSTRACT

A portable dispensing apparatus for dispensing a particulate material such as sand is provided, particularly for dispensing sand into divots made by golfers in the grass playing surface of a golf course when playing golf. The dispensing apparatus includes a container for containing sand and which has an outlet through which the sand can be dispensed, under the force of gravity. A valve member of a valve arrangement is displaceably located with respect to the outlet of the container for opening and blocking the outlet, the valve member being operatively linked with a handle formation for the container which is displaceably located with respect to the container, for displacing the valve member between its open position and its blocking position.

18 Claims, 1 Drawing Sheet

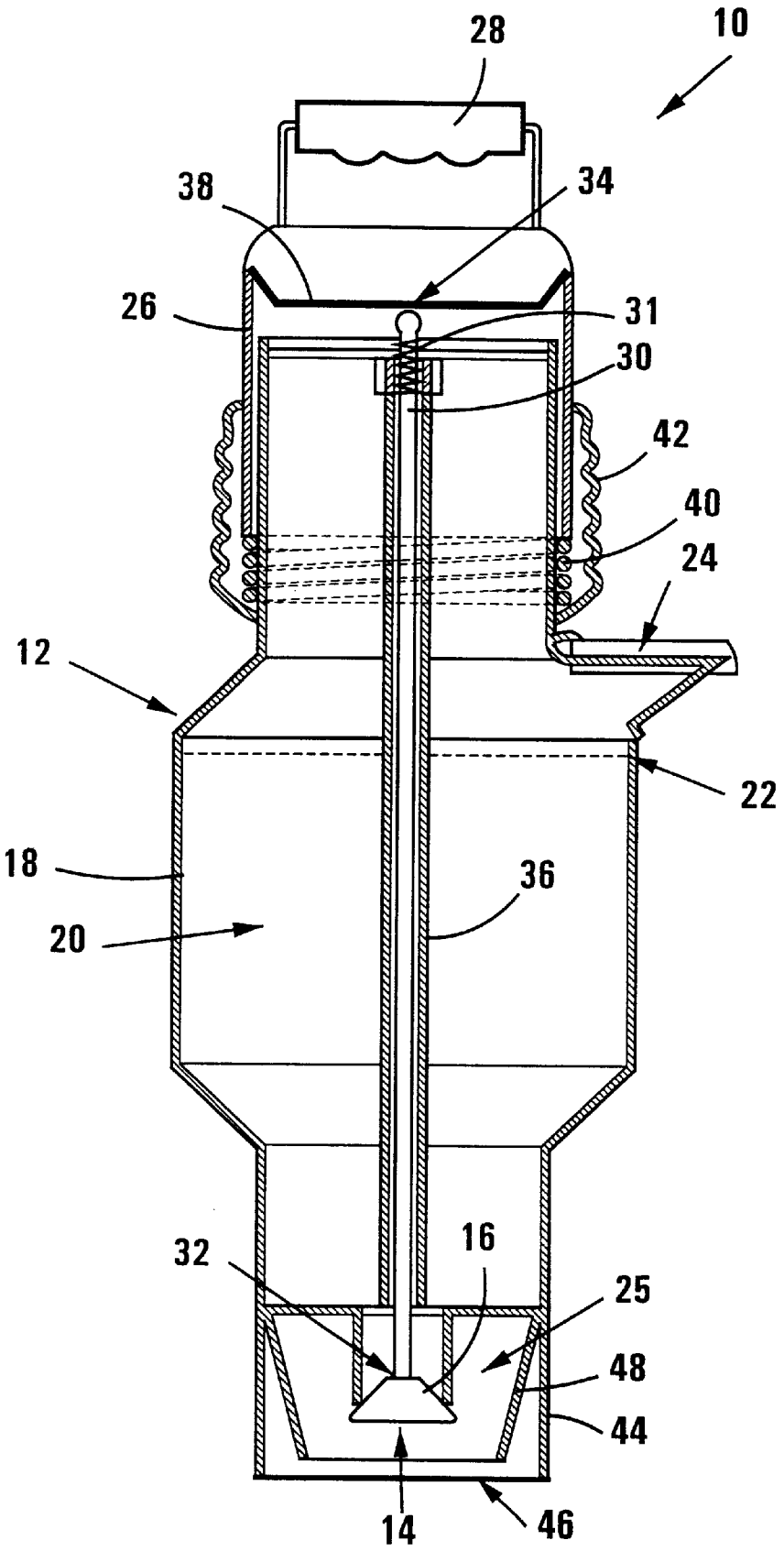
28
10
38
34
26
31
30
42
40
24
12
22
18
36
20
32
16
25
48
44
14
46

PORTABLE DISPENSING APPARATUS

BACKGROUND OF THE INVENTION

THIS INVENTION relates to a portable dispensing apparatus.

The repairing of "divots" in the playing surface of a golf course, made by golfers while playing the game of golf, is both labour intensive and time consuming. Golf course greens staff often use expensive and/or labour intensive methods such as scooping a growing material, usually sand, from buckets, bags and vehicles. By means of a spade or by hand, the sand is then deposited into and around divots formed in the playing surface. Certain golf clubs require golfers to carry sand bags with them and to fill divots caused by them in the playing surface of the golf course. Such sand bags are both cumbersome and messy and the sand obtained from sand bins which are provided at such courses is often soggy and difficult to handle. Furthermore, research has shown that in spite of golfers carrying sand bags on golf courses at golf clubs which require them to do so, the sand bags often are not filled for the reasons set out hereinabove.

SUMMARY OF THE INVENTION

It is thus an object of the present invention to ameliorate many of the problems associated with the repairing of divots made by golfers in the playing surface of a golf course.

According to the invention there is provided a portable dispensing apparatus for dispensing a particulate material, which comprises

- a container for containing the particulate material, the container having an outlet defined in an operative lower region thereof, through which particulate material contained in the container can be dispensed, under the force of gravity, therefrom;
- a handle formation by which the container can be carried in a configuration in which particulate material can be dispensed, under the force of gravity, therefrom; and
- a valve arrangement including a valve member located in a configuration in which it is displaceable between a first position, in which it blocks the outlet of the container, and a second position, in which the outlet is open and it permits dispensing of the particulate material, under the force of gravity, from the container, and a displacement mechanism for displacing the valve member between its first and second positions.

The dispensing apparatus, in accordance with the invention, may be adapted particularly for use in repairing divots made by golfers in grass playing surfaces of golf courses and, as such, the container of the dispensing apparatus is adapted particularly to contain a particulate growing material such as sand and the valve arrangement permits the growing material to be dispensed, under the force of gravity, from the container via the outlet into a divot in a grass surface to be repaired.

A particular embodiment of the invention provides for the displacement mechanism of the valve arrangement and the handle assembly to be operatively linked and for the handle formation to be displaceably located with respect to the container in a configuration in which, by displacement with respect to the container, the displacement mechanism is acted upon for displacing the valve member between its first and second positions. More particularly, the handle formation may be displaceable with respect to the container between first and second positions which coincide respectively with the first and second positions of the valve member of the valve arrangement.

A preferred embodiment of the invention provides for the handle formation to include a gripping handle secured to an inverted cup formation, the cup formation fitting slidably over the operative top region of the container to permit the required displacement of the handle formation with respect to the container. The inverted cup formation may carry an actuating member that acts on the displacement mechanism of the valve arrangement for displacing the valve member between its first and second positions by the displacement of the handle formation.

Accordingly, the dispensing apparatus may include urging means for urging the handle formation into a position in which the valve member of the valve arrangement is disposed in its first position, thus providing for the displacement of the handle formation from its first position to its second position against the urging force of the urging means. The urging means typically is a suitable spring.

Still further according to the invention, the displacement mechanism may include an elongate rod which has one end connected to the valve member of the valve arrangement, the rod extending from the valve member through the container to a location in the operative upper region of the container where its opposite end can be acted upon by the displacement of the handle formation with respect to the container. The dispensing apparatus may include a guide tube that extends through the container and within which the elongate rod of the displacement mechanism is slidably displaceable. The dispensing apparatus also may include further urging means for urging the elongate rod into a position in which the valve member is disposed in its first position, the urging means typically comprising a suitable spring.

Still further according to the invention, the container of the dispensing apparatus may include a base skirt that extends from the opposite lower end thereof to a location beyond the outlet of the container in a configuration in which, by placing the free end of the skirt on the ground, the handle formation is displaceable with respect to the container by bearing down on the handle formation.

The container of the dispensing apparatus also may include a filler opening for filling a particulate material to be dispensed into the container.

BRIEF DESCRIPTION OF THE DRAWING

Further features of a portable dispensing apparatus, in accordance with the invention, are described hereinafter, by way of a non-limiting example of the invention, with reference to and as illustrated in the accompanying diagrammatic drawing which depicts a schematic cross-sectional side view of a portable dispensing apparatus, in accordance with the invention.

DETAILED DESCRIPTION OF THE PREFERRED EMBODIMENT

With reference to the drawing, a portable dispensing apparatus for dispensing sand for repairing divots, made by golfers while playing the game of golf, in the playing surface of a golf course, is designated generally by the reference numeral 10. The dispensing apparatus 10 is intended for use by golf course greens staff for repairing divots in the playing surfaces of golf courses and the Applicant envisages that similar versions thereof also may be used by golfers on golf courses, for repairing divots made by them.

The portable dispensing apparatus 10 comprises, broadly, a container for holding sand, that is designated generally by the reference numeral 12 and that has an outlet 14 through which sand can be dispensed from the container, and a valve arrangement. The valve arrangement includes a valve member 16, for controlling the dispensing of sand through the outlet 14, of the container and a displacement mechanism for displacing the valve member between a closed position (as shown) and an open position as described hereinafter.

The container includes a synthetic plastics container body 18 defining an internal chamber 20 for holding sand. In this regard, it is envisaged by the Applicant that the chamber 20 will be filled with sand to a level indicated by the reference numeral 22. The chamber 20 has operative upper and lower ends, with the container body 18 defining an inlet 24 at the upper end of the chamber through which sand can be introduced into the chamber, the outlet 14 being defined at the lower end of the chamber. The container body defines a profiled section 25 at the lower end of the chamber to assist the movement of sand towards the outlet 14.

The container 18 includes a displaceable inverted cup formation 26 that fits slidably over an operative upper end of the container body 18, as is illustrated in the drawing. The formation 26 is thus located on the container body 18 in an arrangement wherein it is slidably displaceable on the container body 18. The formation 26 has a gripping handle 28 connected thereto, the formation 26 and handle 28 thus forming a handle formation by which the container can be carried.

The displacement mechanism of the valve arrangement includes an elongate rod 30 having an operative lower end 32 and an operative upper end 34, the lower end 32 of the rod being connected to the valve member 16. As such, the rod 30 extends through the chamber 20 of the container body 18 in an arrangement wherein the end 34 of the rod 30 projects from the container body, so as to permit a force to be exerted on the end 34 of the rod for displacing the rod and thereby the valve member 16 into its open position. In order to provide for sliding displacement of the rod in the chamber 20, a fixed elongate guide tube 36 is provided in which the rod 30 is slidably located.

The dispensing apparatus includes first urging means in the form of a compression spring 31 that acts between the container body 18 and the elongate rod 30 for urging the rod into a position which forces the valve member into its closed position, for preventing the flow of sand through the outlet 14 of the container. The formation 26 has an actuating formation 38 located internally therein for pushing against the end 34 of the elongate rod for displacing the rod and thereby displacing the valve member 16 into is open position. Accordingly, in order to displace the rod for displacing the valve member 16 into its open position, the formation 26 is depressed relative to the container body 18 so as to exert a force via the actuating formation 38, on the end 34 of the rod. The apparatus includes also a second urging means in the form of a compression spring 40 that acts between the container body and the formation 26, for urging the actuating formation 38 of the formation 26 away from the end 34 of the rod 30, to ensure thereby that the valve member remains in its closed position unless the formation 26 is depressed to thereby displace the rod.

The dispensing apparatus includes a flexible dust cover 42 that is suitably located on the container body 18 and the formation 26 for preventing dust and other dirt from interfering with the proper functioning of the moving parts of the dispensing apparatus. The dust cover also serves to hold the formation 26 in position on the container body.

The container body defines also a base skirt 44 at an operative lower end region thereof. The base skirt defines a support face 46 by which the container body can be located on a ground surface when dispensing sand, in use. When so positioned, the inverted cup formation 26 can be conveniently depressed with respect to the container body, as described above, whereby dispensing of particulate material directly into a divot is facilitated. The base skirt 44 has an internal funnel-shaped sand guide formation 48 located therein for guiding sand that is dispensed from the outlet 14 of the container body into a required divot. After sufficient sand has been dispensed into a divot, the sand can be suitably levelled with the surrounding grass surface, typically by foot or with the aid of a tool or implement provided for the purpose.

The Applicant believes that the portable dispensing apparatus in accordance with the invention provides a simple yet effective means for repairing divots in the playing surfaces of golf courses.

What is claimed is:

1. A portable dispensing apparatus for dispensing a particulate material, which comprises a container for containing the particulate material, the container having an outlet defined in an operative lower region thereof, through which particulate material contained in the container can be dispensed, under the force of gravity, therefrom;

a valve arrangement including a valve member located in a configuration in which it is displaceable between a first position, in which it blocks the outlet of the container, and a second position, in which the outlet is open and it permits dispensing of the particulate material, under the force of gravity, from the container, and a displacement mechanism that can be acted upon for displacing the valve member between its first and second positions; and a handle formation by which the container can be carried in a configuration in which particulate material can be dispensed, under the force of gravity, therefrom, the handle formation including a gripping handle secured to an inverted cup formation, that fits slidably over an operative top region of the container to permit displacement of the handle formation with respect to the container between first and second positions and that carries an actuating member that operatively links the handle formation and the displacement mechanism of the valve arrangement to provide for the displacement mechanism to be acted upon by the displacement of the handle formation between its first and second positions with respect to the container and for the valve member to be simultaneously displaced between its first and second positions.

2. A dispensing apparatus as claimed in claim 1, in which the container can contain a particulate growing material and the valve arrangement permits the growing material to be dispensed, under the force of gravity, from the container via the outlet into a divot in a grass surface to be repaired.

3. A dispensing apparatus as claimed in claim 1, in which the handle formation is displaceable with respect to the container between first and second positions which coincide respectively with the first and second positions of the valve member of the valve arrangement.

4. A dispensing apparatus as claimed in claim 1, which includes urging means for urging the handle formation into a position in which the valve member of the valve arrangement is disposed in its first position.

5. A dispensing apparatus as claimed in claim 1, in which the displacement mechanism includes an elongate rod which has one end connected to the valve member of the valve arrangement, extending from the valve member through the container to a location in the operative top region of the container where its opposite end can be acted upon by the displacement of the handle formation with respect to the container.

6. A dispensing apparatus as claimed in claim 5, which includes a guide tube that extends through the container and within which the elongate rod of the displacement mechanism is slidably displaceable.

7. A dispensing apparatus as claimed in claim 5, which includes urging means for urging the elongate rod into a position in which the valve member is disposed in its first position.

8. A dispensing apparatus as claimed in claim 1, in which the container includes a base skirt that extends from the operative lower end thereof to a location beyond the outlet of the container in a configuration in which, by placing the free end of the skirt on the ground, the handle formation is displaceable with respect to the container by bearing down on the handle formation.

9. A dispensing apparatus as claimed in claim 1, in which the container has a filler opening for filling a particulate material to be dispensed into the container.

10. A portable dispensing apparatus for dispensing a particulate material, which comprises a container for containing the particulate material, the container having an outlet defined in an operative lower region thereof, through which particulate material contained in the container can be dispensed, under the force of gravity, therefrom;

a handle formation by which the container can be carried in a configuration in which particulate material can be dispensed, under the force of gravity, therefrom; and a valve arrangement including a valve member located in a configuration in which it is displaceable between a first position, in which it blocks the outlet of the container, and a second position, in which the outlet is open and it permits dispensing of the particulate material, under the force of gravity, from the container, and a displacement mechanism that can be acted upon for displacing the valve member between its first and second positions;

the displacement mechanism of the valve arrangement and the handle formation being operatively linked and the handle formation is displaceably located with respect to the container in a configuration in which, by its displacement with respect to the container, the displacement mechanism is acted upon for displacing the valve member between its first and second positions, the handle formation including a gripping handle secured to an inverted cup formation, and in which the cup formation fits slidably over an operative top region of the container to permit the required displacement of the handle formation with respect to the container.

11. A dispensing apparatus as claimed in claim 10, in which the container can contain a particulate growing material and the valve arrangement permits the growing material to be dispensed, under the force of gravity, from the container via the outlet into a divot in a grass surface to be repaired.

12. A dispensing apparatus as claimed in claim 10, in which the handle formation is displaceable with respect to the container between first and second positions which coincide respectively with the first and second positions of the valve member of the valve arrangement.

13. A dispensing apparatus as claimed in claim 10, which includes urging means for urging the handle formation into a position in which the valve member of the valve arrangement is disposed in its first position.

14. A dispensing apparatus as claimed in claim 10, in which the displacement mechanism includes an elongate rod which has one end connected to the valve member of the valve arrangement, extending from the valve member through the container to a location in the operative top region of the container where its opposite end can be acted upon by the displacement of the handle formation with respect to the container.

15. A dispensing apparatus as claimed in claim 14, which includes a guide tube that extends through the container and within which the elongate rod of the displacement mechanism is slidably displaceable.

16. A dispensing apparatus as claimed in claim 14, which includes urging means for urging the elongate rod into a position in which the valve member is disposed in its first position.

17. A dispensing apparatus as claimed in claim 10, in which the container includes a base skirt that extends from the operative lower end thereof to a location beyond the outlet of the container in a configuration in which, by placing the free end of the skirt on the ground, the handle formation is displaceable with respect to the container by bearing down on the handle formation.

18. A dispensing apparatus as claimed in claim 10, in which the container has a filler opening for filling a particulate material to be dispensed into the container.

* * * * *